US006244057B1

(12) United States Patent
Yoshida et al.

(10) Patent No.: US 6,244,057 B1
(45) Date of Patent: Jun. 12, 2001

(54) AIR CONDITIONER

(75) Inventors: Yasutaka Yoshida, Shimizu; Susumu Nakayama, Shizuoka; Koji Naito, Shimizu; Satoru Yoshida, Shimizu; Hiroshi Takenaka, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/391,406

(22) Filed: Sep. 8, 1999

(30) Foreign Application Priority Data

Sep. 8, 1998 (JP) ..... 10-253882

(51) Int. Cl.[7] ..... F25B 29/00

(52) U.S. Cl. ..... 62/160; 62/151; 62/278; 62/324.5

(58) Field of Search ..... 62/160, 151, 152, 62/81, 278, 277, 324.1, 324.5, 324.6, 155, 156, 234

(56) References Cited

U.S. PATENT DOCUMENTS 4,779,425 * 10/1988 Yoshihisa et al. ..... 62/278 X
5,159,817 * 11/1992 Hojo et al. ..... 62/81
5,720,179 * 2/1998 Jung ..... 62/324.6 X
5,823,006 * 10/1998 Jung ..... 62/324.6 X

FOREIGN PATENT DOCUMENTS 5-141817 * 6/1993 (JP) ..... 62/278

OTHER PUBLICATIONS

Japanese Patent Unexamined Publication No. 5–71822.
Japanese Patent Unexamined Publication No. 6–341726.

* cited by examiner

*Primary Examiner*—Harry B. Tanner
(74) *Attorney, Agent, or Firm*—Antonelli, Terry, Stout & Kraus, LLP

(57) ABSTRACT

An air conditioner comprising a refrigerant forward path branching on a discharge side of a compressor in an outdoor unit, one of the branched portions being defined by connecting a first four-way valve, a first outdoor heat exchanger and a first outdoor expansion valve to one another in this order, and the other of the branched portions being defined by connecting a second four-way valve, a second outdoor heat exchanger and a second outdoor expansion valve in this order, the path extending to an indoor unit from the respective outdoor expansion valves through a liquid-side piping, and returning to the outdoor unit from the indoor unit through a gas-side piping to branch, one of the branched portions being connected to the first four-way valve via a check valve placed in communication in a forward direction and the other of the branched portions being connected to the second four-way valve, the air conditioner being controlled such that, when heating operation is switched to defrosting operation, the second four-way valve is switched if a pressure difference between discharge pressure and suction pressure of the compressor is equal to or above a predetermined value, and the first four-way valve is switched after a gas-side pressure of the second outdoor heat exchanger has risen, whereby the four-way valves are prevented from being made inoperative due to short-circuit between high pressure side and low pressure side.

6 Claims, 9 Drawing Sheets

AIR CONDITIONER

BACKGROUND OF THE INVENTION

The present invention relates to an air conditioner comprising one outdoor unit and one or more indoor units, the outdoor unit having two lines composed of a four-way valve, an outdoor heat exchanger and an outdoor expansion valve, and more particularly, to an air conditioner which is suitable for performing switching between operation modes of cooling, heating and defrosting smoothly without any trouble.

PRIOR ART

In an air conditioner of heat pump refrigerating cycle, a refrigerant in an outdoor heat exchanger becomes hard to evaporate and so decreases in evaporating pressure and temperature when outside air temperature decreases during heating operation. Therefore, air, which is performing heat exchange, decreases in condensing temperature, and moisture in the air sticks to surfaces of the outdoor heat exchanger as frost, which must be removed. In a refrigerating cycle with one four-way valve, defrosting methods include an inverse cycle defrosting method, in which switching of a four-way valve causes a high-pressure and high-temperature refrigerant to flow into an outdoor heat exchanger in the same forward circulating direction as that in cooling operation, and a hot gas defrosting method, in which a bypass circuit for bypassing to an outdoor heat exchanger from the vicinity of a compressor discharge port is opened/closed to permit a high-temperature refrigerant to inflow.

When the inverse cycle defrosting is performed, the four-way valve is switched, at which there is a fear that the four-way valve becomes inoperative. With a conventional air conditioner operating in refrigerating cycle and having only one four-way valve, it suffices that a pressure difference between compressor refrigerant discharge pressure (high pressure side) and compressor refrigerant suction pressure (low pressure side) be taken into account with respect to inoperability of the four-way valve when inverse cycle defrosting is performed. The reason for this is that a pressure difference between the high pressure side and the low pressure side serves as a drive force for operating the four-way valve, and so when the pressure difference is sufficient, the four-way valve operates even upon transmission of a signal for operating the four-way valve, without becoming inoperative. However, in the inverse cycle defrosting in refrigerating cycle having only one four-way valve, building-up of pressure difference for avoiding inoperability imparts a shock to piping constituting the refrigerating cycle, which results in vibrations of the piping and impulsive sound caused thereby.

On the other hand, in an air conditioner of refrigerating cycle having a plurality of four-way valves, shocks on piping can be reduced since the plurality of four-way valves are switched successively when modes of cooling, heating, and defrosting are switched. However, in the air conditioner of refrigerating cycle having a plurality of four-way valves, only a pressure difference between the high pressure side and the low pressure side may possibly be insufficient. More specifically, the air conditioner is put into an inoperative mode as in the case of ON-ON combination shown in FIG. 8D. Specifically, a high pressure refrigerant discharged from the compressor passes through a second four-way valve 10-2 to branch into two parts, and one of the parts is fed toward an indoor unit, but the other of the parts flows into a suction side (low pressure side) of a compressor 6 through a check valve and a first four-way valve 10-1, whereby the high pressure side and the low pressure side are short-circuited and so cannot provide a pressure difference between the high pressure side and the low pressure side, resulting in an inoperative mode, in which the four-way valve cannot be operated once again.

An object of the present invention is to provide an air conditioner provided with an outdoor unit having two lines composed of a four-way valve, an outdoor heat exchanger, and an outdoor expansion valve, and the air conditioner being capable of avoiding an inoperative mode, and has high reliability and stability.

SUMMARY OF THE INVENTION

To solve the above problems, the present invention provides an air conditioner comprising an outdoor unit, an indoor unit or units connected to the outdoor unit by a liquid-side piping and a gas-side piping, and a forward circulating path of a refrigerant, the outdoor unit being constructed such that one of pipes branching on a discharge side of a drive frequency variable type compressor is connected to a first four-way valve, a first outdoor heat exchanger and a first outdoor expansion valve in this order, the other of the pipes is connected to a second four-way valve, a second outdoor heat exchanger and a second outdoor expansion valve in this order, and outflowing sides of the respective outdoor expansion valves join together to be connected to the liquid-side piping, and the indoor unit or units being constructed such that an indoor expansion valve and an indoor heat exchanger are connected in this order from the liquid piping side, and that one of pipes, which returns to the outdoor unit from the gas-side piping connected to the indoor heat exchanger and branch, is connected to the first four-way valve via a check valve placed in communication in a forward direction, and the other of the pipes is connected to the second four-way valve, the refrigerant flowing along the forward circulating path at the time of cooling and defrosting operations and flowing in a direction reverse to the forward circulating path at the time of heating operation, the air conditioner comprising respective means for sensing discharge pressure and suction pressure of the compressor, respectively, respective means for sensing gas-side pressures of the respective outdoor heat exchangers, and a four-way valve control device for operating the first and second four-way valves on the basis of detected values of the respective pressures, the four-way valve control device controlling, when heating operation is switched over to defrosting operation, (2) to first switch the second four-way valve (1) if a pressure difference between the compressor discharge pressure and the compressor suction pressure is equal to or above a predetermined value, and (4) to switch the first four-way valve (3) after the gas-side pressure of the second outdoor heat exchanger has risen.

Also, the four-way valve control device controls, when defrosting operation is returned to heating operation, (2') to first switch the first four-way valve (1') if a pressure difference between the compressor discharge pressure and the compressor suction pressure is equal to or above a predetermined value, and (4') to switch the second four-way valve (3') after the gas-side pressure of the first outdoor heat exchanger has decreased.

DESCRIPTION OF PREFERRED EMBODIMENTS

An embodiment of the present invention will now be described concretely with reference to the accompanying drawings.

Figure 2:
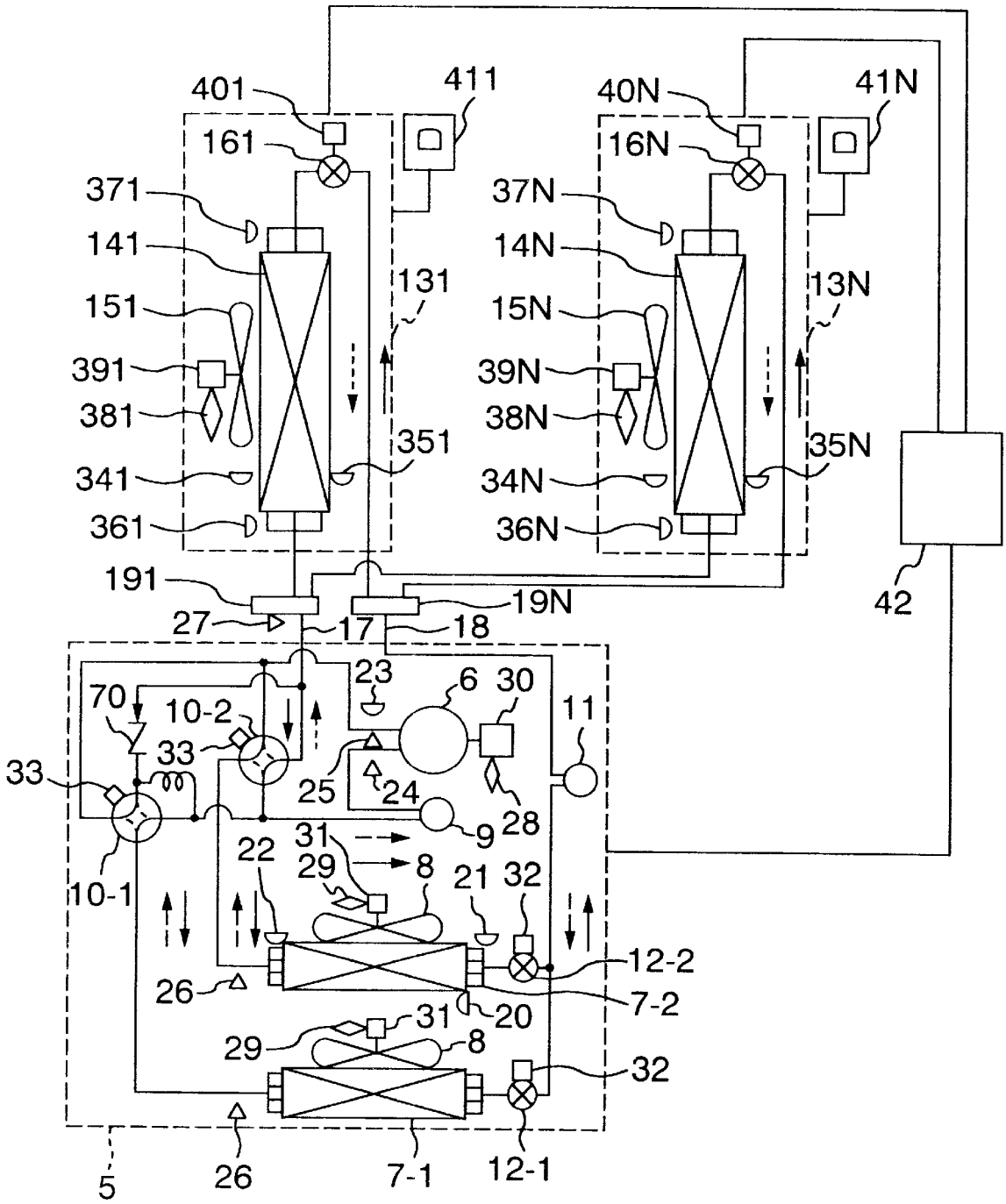
FIG. 2 is a schematic view of an air conditioner in accordance with one embodiment of the present invention.

FIG. 2 is a schematic view of an air conditioner in accordance with an embodiment of the present invention. The air conditioner comprises an outdoor unit 5 and a plurality (N in number) of indoor units 131, 13N, which are connected to an outdoor unit 5 and are arranged in parallel to each other. The outdoor unit 5 and the respective indoor units 131, 13N are connected through piping to form a closed circuit, in which a refrigerant is charged. In addition, the air conditioner may be comprised of a combination of one outdoor unit and one indoor unit.

The outdoor unit 5 comprises one or more drive frequency variable type compressors 6; a first four-way valve 10-1, a first outdoor heat exchanger 7-1 and a first outdoor expansion valve 12-1, which are connected in succession on the discharge side of the compressor 6 through piping; and a second four-way valve 10-2, a second outdoor heat exchanger 7-2 and a second outdoor expansion valve 12-2, which are similarly connected in succession on the discharge side of the compressor 6 through piping. The set of first four-way valve 10-1, the first outdoor heat exchanger 7-1 and the first outdoor expansion valve 12-1, and the set of second four-way valve 10-1, the second outdoor heat exchanger 7-2 and the second outdoor expansion valve 12-2 are connected to the compressor 6 in parallel to each other. The first outdoor heat exchanger 7-1 and the second outdoor heat exchanger 7-2, respectively, are provided with an outdoor fan 8. A check valve 70 is provided on a piping leading to the first four-way valve 10-1 in the outdoor unit 5 from a gas-side piping 17 between the indoor unit and the outdoor unit. The second four-way valve 10-2 is directly connected to the gas-side piping 17 with a piping. In addition, the outdoor unit 5 is provided with an accumulator 9 on the refrigerant suction side of the compressor 6 and a liquid tank 11.

On the other hand, the indoor unit 131 comprises an indoor expansion valve 161 and an indoor heat exchanger 141, which are connected in succession through a piping, and the indoor unit 13N comprises an indoor expansion valve 16N and an indoor heat exchanger 14N, which are connected in succession through piping. Also, the indoor heat exchanger 141 is provided with an indoor fan 151, and the indoor heat exchanger 14N is provided with an indoor fan 15N. Air blasting produced by the respective indoor fans 151, 15N is made use of to make the indoor heat exchangers 141, 14N effect heat exchange with the room air. The respective indoor expansion valves 161, 16N regulate flow rates of the refrigerant flowing through the respective indoor heat exchangers 141, 14N.

The outdoor unit 5 is connected to the respective indoor units 131, 13N by way of the gas-side pipe line 17 via a branch pipe 191 and by way of a liquid-side pipe line 18 via a branch pipe 19N, so that closed circuits are formed between the outdoor unit 5 and the respective indoor units 131, 13N. The refrigerant is charged in the closed circuits.

Further, the outdoor unit 5 further comprises a temperature sensor 20 for sensing outdoor air temperature, a temperature sensor 21 for sensing liquid-side temperature in the outdoor heat exchanger, a temperature sensor 22 for sensing gas-side temperature in the outdoor heat exchanger, a refrigerant discharge temperature sensor 23 for the compressor 6, a refrigerant suction pressure sensor 24 for the compressor 6, a discharge pressure sensor 25 for the compressor 6, pressure sensors 26 for sensing gas-side pressures in the first and second outdoor heat exchangers 7-1 and 7-2, a pressure sensor 27 for sensing pressure in the gas-side pipe line 17 between the outdoor unit and the indoor unit, a power detector 28 for detecting power consumption of the compressor 6, respective power detectors 29 for detecting power consumption of the respective outdoor fans 8, an inverter compressor drive frequency regulator 30 for regulating frequency of the compressor 6, respective air blasting capacity regulators 31 for regulating air blasting capacities of the respective outdoor fans 8, respective opening degree regulators 32 for regulating opening degrees of the first and second outdoor expansion valves 12-1 and 12-2, and respective four-way valve operating devices 33 for performing an operation of switching directions of refrigerant in the respective first and second four-way valves 10-1 and 10-2.

On the other hand, the respective indoor units 131, 13N comprise temperature sensors 341, 34N for sensing room air temperature, temperature sensors 351, 35N for sensing blown air temperatures, power detectors 381, 38N for detecting power consumption of the indoor fans 151, 15N, air blasting capacity regulators 391, 39N for regulating air blasting capacities of the indoor fans 151, 15N, indoor expansion opening degree regulators 401, 40N for regulating opening degrees of the indoor expansion valves 161, 16N, and remote controllers 411, 41N for storing given set values of temperature and humidity or for setting temperature and humidity preferred by users.

Further, there is provided an automatic operation device 42 for judging whether or not defrosting should be started at need.

Electric wiring is provided on the automatic operation device 42 so that the device reads such detection signals and computes and controls regulated amounts of the frequency regulator 30, the respective air blasting capacity regulators 31 for the outdoor fans, the respective opening degree regulators 32 for the respective outdoor expansion valves, the respective four-way valve operating devices 33, the air blasting capacity regulators 391, 39N for the respective indoor fans, and the indoor expansion opening degree regulators 401, 40N for respective the indoor expansion valves.

When the aforementioned air conditioner is operated in cooling mode, the compressor 6 starts and performs compressing action, whereby the charged refrigerant is compressed and overheated to flow toward the first and second outdoor heat exchangers 7-1 and 7-2. The refrigerant is cooled and liquefied there by outdoor air, and gives a quantity of heat to the outdoor air. Further, the refrigerant passes through the outdoor expansion valves 12-1 and 12-2 and the indoor expansion valve 161, 16N for performing expanding action, so that the refrigerant is decreased in pressure and flows into the indoor heat exchangers. The refrigerant is heated and evaporated there by room air, and taking heat from the room air. The refrigerant as evaporated flows into the compressor again to be compressed, and repeats the aforementioned action. On the other hand, when the air conditioner is operated in heating mode, the refrigerant compressed and overheated by the compressor 6 flows toward the indoor heat exchanger 141, 14N. The refrigerant is cooled and liquefied there by room air, and gives heat to the air. Further, the refrigerant passes through the indoor expansion valves 161, 16N and the outdoor expansion valves 12-1 and 12-2 for performing expansion action, so that it is decreased in pressure and flows into the outdoor heat exchanger. The refrigerant is heated and evaporated there by outside air, and takes a quantity of heat from the air. The evaporated refrigerant as evaporated flows into the compressor again to be compressed, and repeats the aforementioned action. This is a behavior of the refrigerant in series in the air conditioner. The automatic operation device controls temperature and humidity of the room air, and performs control of the refrigerant temperature and pressure and judges whether defrosting should be started or not, in the air conditioner which is a thermal load apparatus.

However, the outdoor unit of the air conditioner includes two four-way valves, and the refrigerant path is varied depending on a combination of ON and OFF of the valves, so that four modes are presented as shown in FIGS. 8A to 8D. In OFF-OFF mode shown in FIG. 8A, the refrigerant from the compressor 6 and passed through the first four-way valve 10-1 is blocked and prevented by the check valve 70 from flowing while the refrigerant having passed through the second four-way valve 10-2 flows into the second outdoor heat exchanger 7-2, so that the refrigerating cycle performs cooling operation as a whole. The refrigerant returned to the outdoor unit from the indoor units passes through the second four-way valve 10-2 to be returned to the compressor 6. In this mode, only one of the two outdoor heat exchangers functions, which is referred to as cooling operation of a first mode. In ON-OFF mode shown in FIG. 8B, the refrigerant from the compressor 6 and passed through the first four-way valve 10-1 flows into the first outdoor heat exchanger 7-1, and the refrigerant having passed through the second four-way valve 10-2 flows into the outdoor heat exchanger 7-2, so that cooling operation is effected. The refrigerant returned to the outdoor unit 5 from the indoor units passes through the first and second four-way valves 10-1 and 10-2 to be returned to the compressor 6. In this mode, two of the outdoor heat exchangers function, which is referred to as cooling operation of a second mode. In OFF-ON mode shown in FIG. 8C, the refrigerant from the compressor 6 and passed through the second four-way valve 10-2 is directed to the indoor heat exchanger 141, 14N, thus performing heating operation. The refrigerant having passed through the first four-way valve 10-1 is blocked and prevented by the check valve 70 from flowing. On the other hand, the refrigerant returned to the outdoor unit 5 from the indoor units passes through the first four-way valve via the first outdoor expansion valve 12-1 and the first outdoor heat exchanger 7-1, and passes in parallel through the second four-way valve via the second outdoor expansion valve 12-2 and the second outdoor heat exchanger 7-2 to be returned to the compressor 6. In this mode, two of the outdoor heat exchangers function, in which only one kind of heating operation is effected.

Figure 8A:
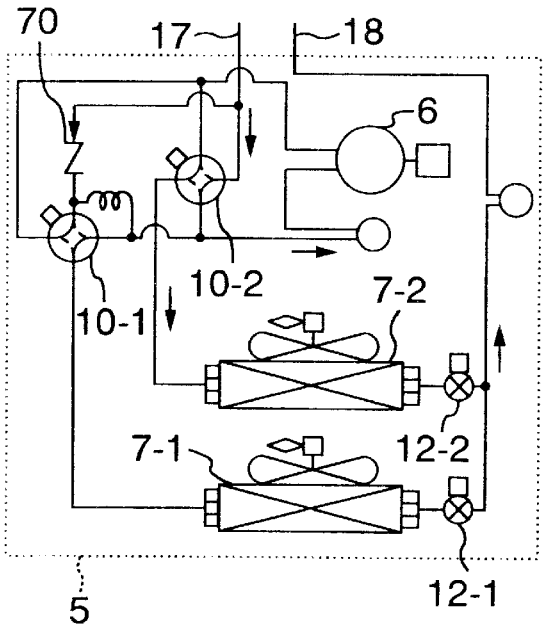
FIGS. 8A to 8D are schematic views showing operation modes of a refrigerating cycle having two four-way valves.
Figure 8B:
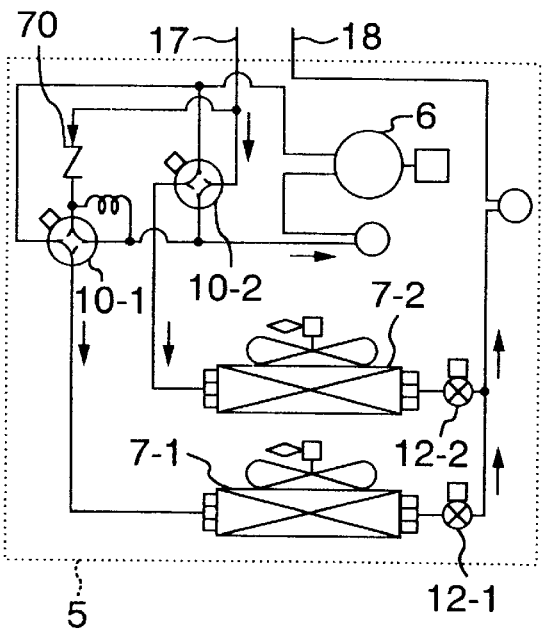
Figure 8C:
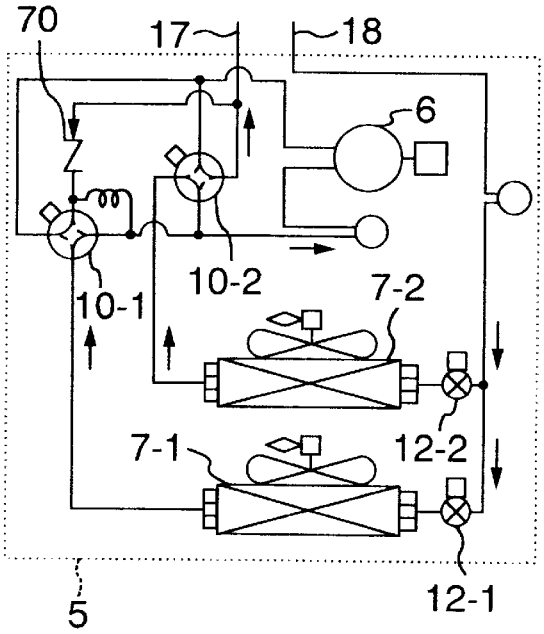
Figure 8D:
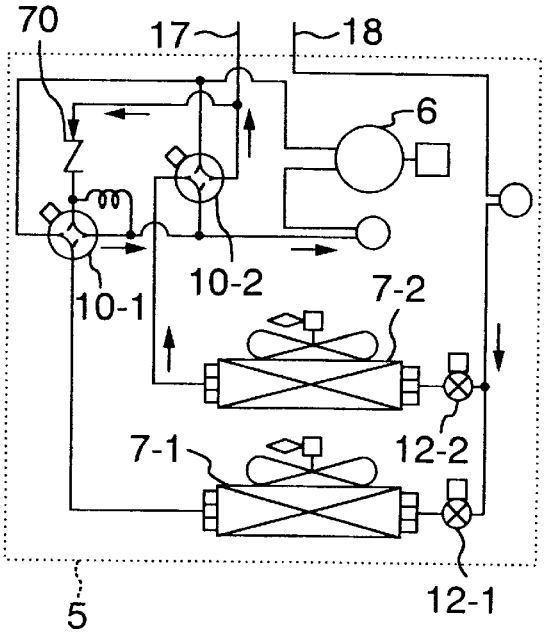

However, in ON-ON mode shown in FIG. 8D, the refrigerant from the compressor 6 and passed through the second four-way valve 10-2 is directed to the indoor heat exchanger 141, 14N to perform heating operation. The refrigerant having been used for such heating is returned to the outdoor unit 5 from the indoor units. On the other hand, the refrigerant, which is from the compressor 6 and passed through the second four-way valve 10-2, branches off and passes through the first four-way valve 10-1 through the check valve 70 (forward direction), comes across the refrigerant, which returns to the outdoor unit from the indoor units via the first outdoor expansion valve 12-1 and the first outdoor heat exchanger 7-1, to be short-circuited to the lower pressure side as it is. Therefore, although the compressor 6 is operated, the pressure difference decreases, resulting in inoperative mode, in which the respective four-way valves are made inoperative. Such a state should be avoided by all means because it makes the operation of the air conditioner impossible.

Thereupon, a four-way valve switching method should be used which prevents the four-way valves from being made in the inoperative mode. This method is applied at the time of switching from the heating operation (FIG. 8C), in which both of the two four-way valves must be operated, to the defrosting operation (FIG. 8B) and switching from the defrosting operation to the heating operation. Fundamentally, at the start of defrosting (FIG. 8C→FIG. 8B), the second four-way valve 10-2 is first operated, and the first four-way valve 10-1 is operated with a time lag, and at the completion of defrosting (FIG. 8B→FIG. 8C), the first four-way valve 10-1 is first operated, and the second four-way valve 10-2 is operated with a time lag in a similar manner.

However, it becomes a problem how long the time lag should be. The matter is simple with a fixed time lag such as 3 seconds or 5 seconds, but a set time is not always optimal depending on the operation condition.

Figure 1A:
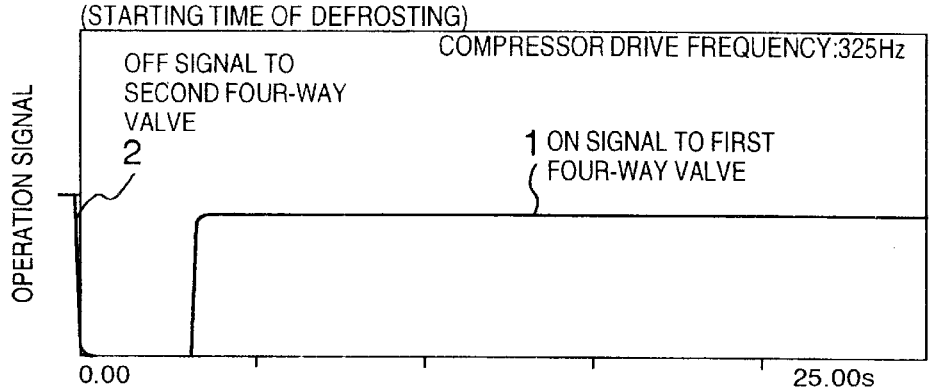
FIGS. 1A and 1B are diagrams showing timing of ON and OFF signals to first and second four-way valves and changes in pressure on gas sides of first and second outdoor heat exchangers at the start of defrosting in the case where the compressor drive frequency is high in an air conditioner in accordance with the present invention.
Figure 1B:
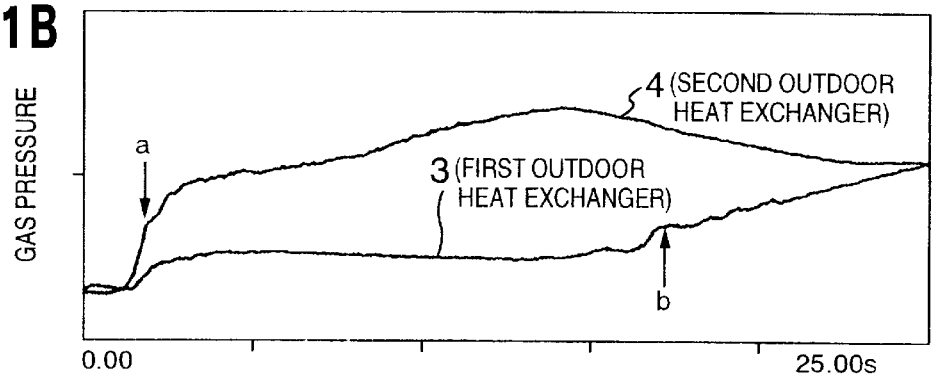

FIG. 1 shows a change in gas-side pressure of the first outdoor heat exchanger 7-1 and the second outdoor heat exchanger 7-2 in the case where two four-way valves are operated with a fixed time lag of 3 seconds in an air conditioner equipped with the two four-way valves. The reference numerals 1 and 2 indicative of ON and OFF of the four-way valves designate operation signal voltages, and do not designate actual ON and OFF action of the valve bodies. When the operation signal (2) of the second four-way valve 10-2 is turned OFF, the gas-side pressure (4) of the second outdoor heat exchanger 7-2 rises after about 1 second (point a in the figure). Thus it can be estimated that the valve body of the second four-way valve 10-2 is still OFF. The reason why the gas-side pressure (3) of the first outdoor heat exchanger 7-1 has also risen to a small extent at this time is that the refrigerant is short-circuited to flow into the first outdoor heat exchanger 7-1 through the first and second outdoor expansion valves 12-1 and 12-2, and not that the first four-way valve 10-1 has been switched. It is found that after 3 seconds elapse since the operation signal of the second four-way valve 10-2 is turned OFF, the operation signal (1) of the first four-way valve 10-1 is turned ON, and after about 15 seconds (point bin the figure), the valve body of the first four-way valve 10-1 is moved, and the gas-side pressure (3) of the first outdoor heat exchanger 7-1 rises. The compressor drive frequency is 325 Hz, the operating indoor unit capacity is about 26 hp, and the air temperature condition is the standard defrosting condition. FIGS. 8A to 8D show positions of the valve when the first and second four-way valves 10-1 and 10-2, respectively, are ON or OFF.

Figure 3A:
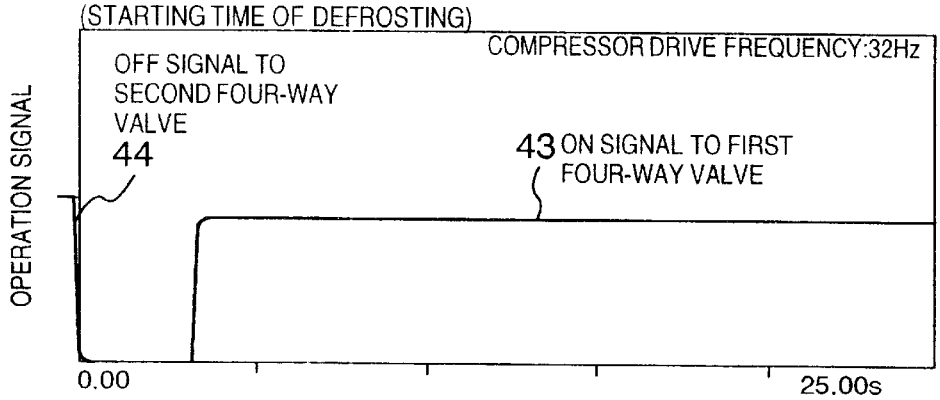
FIGS. 3*a* and 3B are diagrams showing timing of ON and OFF signals to first and second four-way valves and changes in pressure on gas sides of first and second outdoor heat exchangers at the start of defrosting in the case where the compressor drive frequency is low in an air conditioner in accordance with the present invention.
Figure 3B:
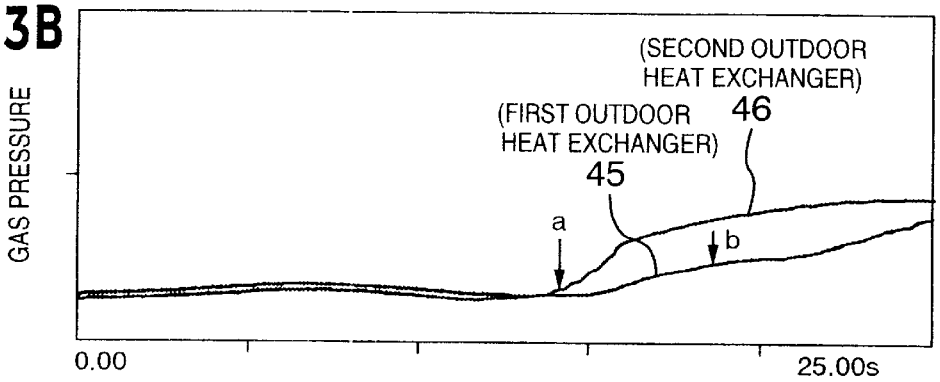

Here, if the compressor drive frequency is made small, a state becomes such as shown in FIG. 3. As seen from the figure, the gas-side pressure (46) of the second outdoor heat exchanger 7-2 rises after the lapse of about 15 seconds (point a in the figure) since the operation signal (44) of the second four-way valve 10-2 is turned OFF. Thus it can be estimated that the valve body of the second four-way valve 10-2 is turned OFF, and further after the lapse of about 5 seconds (point b in the figure) since then, the gas-side pressure (45) of the first outdoor heat exchanger 7-1 rises. So, it can be found that the valve body of the first four-way valve 10-1 is turned ON. The compressor drive frequency is 32 Hz, the operating indoor unit capacity is 1 hp, and the air temperature condition is the standard defrosting condition.

In this manner, if the compressor drive frequency is changed, the valve bodies operate differently in time since after the signal is turned ON or OFF. This is because the driving force for operating the valves changes due to pressure difference. Such time lag relates to not only the compressor drive frequency as described above but also friction of the four-way valves or the like, so that it also differs depending on the individual difference and the secular change of the four-way valves.

For this reason, the following must be noted.

If the compressor drive frequency is high as shown in FIG. 1, the four-way valve rapidly operates. If the operation signal of the first four-way valve 10-1 is turned ON too late after the operation signal of the second four-way valve 10-2 is turned OFF, a period of time, during which the valve body of the second four-way valve 10-2 is OFF, becomes long, so that the pressure difference becomes unsuitable. For example, at the start of defrosting, if it is tried to turn the first four-way valve 10-1 ON after the pressure difference has disappeared, reliability whether the operation of the first four-way valve 10-1 is surely carried out is lowered, and the intermediate stoppage of valve body is feared.

On the other hand, if the compressor drive frequency is low as shown in FIG. 3, the four-way valve is operated lately. If the operation signal of the first four-way valve 10-1 is turned ON too early after the operation signal of the second four-way valve 10-2 is turned OFF, the operation signal of ON is prematurely sent to the first four-way valve 10-1 though the valve body of the second four-way valve 10-2 has not yet been turned OFF, so that the initial purpose of operating the second four-way valve 10-2 first is not achieved. In this manner, the inoperative mode may predominate even in such state. Thus, attention must be given to the fact that unless a time lags between points of time, at which the two four-way valves are operated, is suitably changed depending upon the operating condition, the two four-way valves 10-2 cannot be switched properly.

Therefore, an explanation will be given to a method for setting time lags among a point of time, at which the two four-way valves are operated, to a value suitable for the operation in accordance with the operating condition. When the first four-way valve 10-1 or the second four-way valve 10-2 is operated, the compressor refrigerant suction pressure, the gas-side pressure of the first outdoor heat exchanger 7-1, and the gas-side pressure of the second outdoor heat exchanger 7-2 change. As described above, the gas-side pressure of the first outdoor heat exchanger 7-1 directly connected to the first four-way valve 10-1 changes more vividly than the compressor refrigerant suction pressure when the valve body of the first four-way valve 10-1 changes, and the gas-side pressure of the second outdoor heat exchanger 7-2 directly connected to the second four-way valve 10-2 changes more vividly than the compressor refrigerant suction pressure when the valve body of the second four-way valve 10-2 changes, so that an amount of change in the pressure is detected so as to operate the respective four-way valves. Based on the above matter, a change in the gas-side pressure of the outdoor heat exchanger $$\delta P = (\text{pressure after switching signal}) - (\text{pressure before switching pressure})$$

is taken into account. However, since pressure variation is rapid as compared with a sampling time required for the operation of conventional air conditioners, the sampling time is made premature at the start and completion of defrosting so as to respond to the changing value.

It is assumed here that the defrosting start condition is met with, and the arithmetic operation device 42 has determined switching from the heating operation to the defrosting operation (FIG. 8C→FIG. 8B).

The arithmetic operation device 42 is assumed to issue an OFF operation signal to the second four-way valve 10-2. Then, after the valve body of the second four-way valve 10-2 is operated (a state shown in FIG. 8A), the gas-side pressure of the second outdoor heat exchanger 7-2 begins to rise. At this time, it is deemed that the valve body of the second four-way valve 10-2 is operated when the increased value (δP) reaches a predetermined a threshold value (Pth), $$\delta P \geqq Pth \quad (1)$$

and an operation signal ON is immediately sent to the first four-way valve 10-1. In this manner, neither a time lag is made excessive to make the differential pressure improper nor the operation is made premature. Therefore, the two four-way valves can be operated securely without causing the inoperative mode. In addition, when switching is made from the heating operation to the defrosting operation as described above, the port positions of the two four-way valves are shown by FIGS. 8C→8A→8B. Inversely, when a return is made from the defrosting operation to the heating operation, the port positions of the two four-way valves are changed in the manner shown by FIGS. 8B→8A→8C.

Figure 4A:
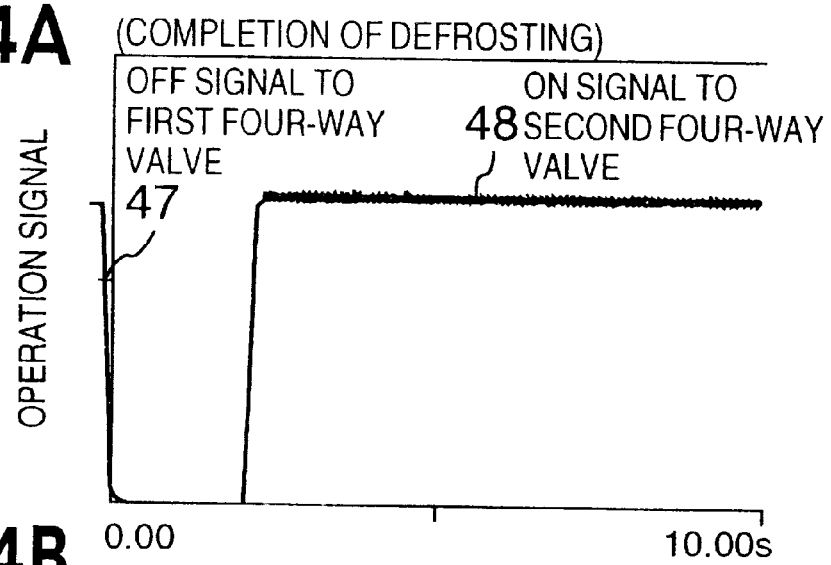
FIGS. 4*a* and 4B are diagrams showing changes in compressor refrigerant discharge pressure and refrigerant suction pressure when first and second four-way valves are switched at the completion of defrosting.
Figure 4B:
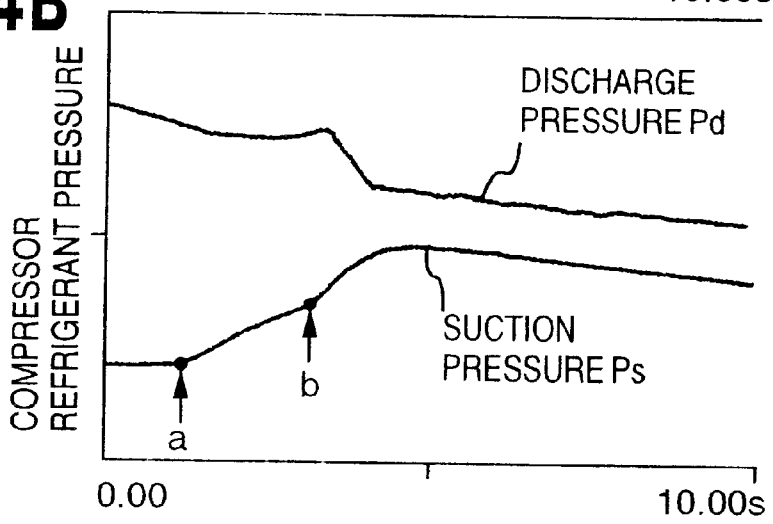

However, the gas-side pressure sensors for the outdoor heat exchangers 7-1 and 7-2 are not provided in many products (air conditioners), in which case additional sensors must be provided, and so the use of the above-described method as it is leads to an increased cost and is not necessarily advantageous. For this reason, in place of changes in the gas-side pressure of the first outdoor heat exchanger 7-1 and the gas-side pressure of the second outdoor heat exchanger 7-2, changes in the compressor refrigerant suction pressure are employed with the use of a compressor refrigerant pressure sensor that is provided in most products. FIG. 4 shows ON and OFF signals of the first and second four-way valves, a change in the compressor refrigerant discharge pressure, and a change in the compressor refrigerant suction pressure at the completion of defrosting. A point a on a curve of the suction pressure Ps indicates a point of time when the body of the first four-way valve 10-1 is turned OFF to cause a pressure rise, and a point of time b indicates the time when the body of the second four-way valve is turned ON to cause a pressure rise. As shown in the drawing, the change in the compressor refrigerant suction pressure is not so definite as the change in the gas-side pressures of the outdoor heat exchangers, but can serve sufficiently in place of the gas-side pressures of the outdoor heat exchangers.

The above-described switching control of the four-way valves also provides the following effects.

When defrosting is made, in particular, when the operation is returned from the defrosting operation to the heating operation, the refrigerant flow changes suddenly in the pipe to cause fluid forces on the bent part of the piping. Therefore, the piping vibrates intensely to strike, for example, a ceiling or the like of a house or a building, which gives unnecessary shocks and impulsive sound to people on the lower and upper floors.

Figure 5:
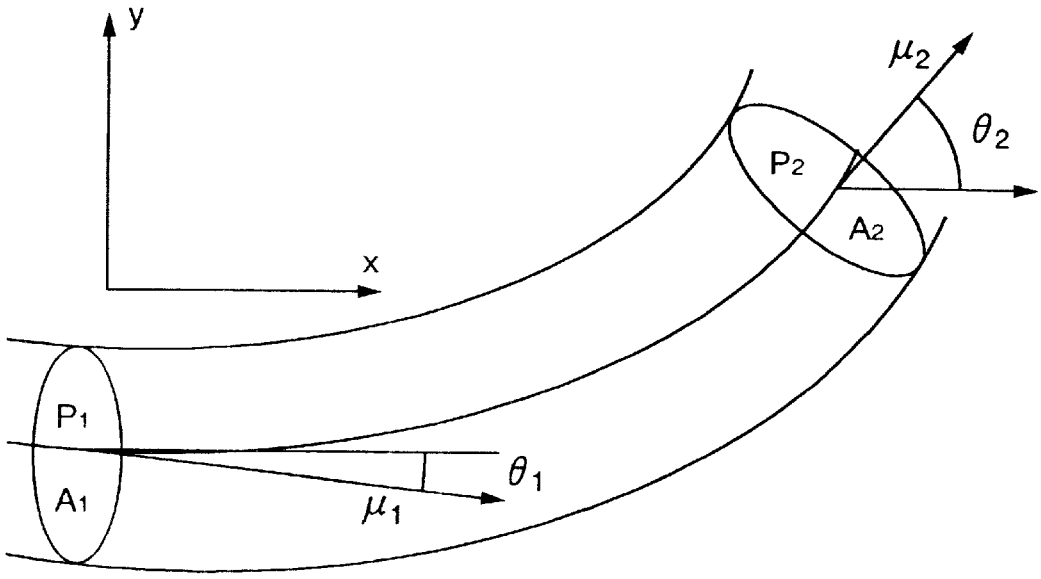
FIG. 5 is a view showing a piping model, of which vibration is considered.

Such piping shocks and impulsive sound caused by the fluid forces depend on sudden changes in fluid pressure, changes in velocity, and the density. As shown in FIG. 5, two cross sections of the piping are used as control sections, and for the control sections 1 and 2, respectively, bending angles of the piping are designated by $\theta_1$ and $\theta_2$, crosssectional areas of the pipe piping are designated by $A_1$ and $A_2$, the density of fluid is designated by $\rho$, the fluid velocities are designated by $u_1$ and $u_2$, the fluid pressures are designated by $p_1$ and $p_2$, and a volume flow rate is designated by Q, the fluid forces are expressed as x direction:

$$Fx=\rho\cdot Q(u_1\cdot\cos\theta_1-u_2\cdot\cos\theta_2)+A_1\cdot p_1\cdot\cos\theta_1-A_2\cdot p_2\cos\theta_2 \quad (2)$$

y direction:

$$Fy=\rho\cdot Q(u_1\cdot\sin\theta_1-u_2\cdot\sin\theta_2)+A_1\cdot p_1\cdot\sin\theta_1-A_2\cdot p_2\sin\theta_2 \quad (3)$$

resultant force:

$$F=(Fx^2+Fy^2)^{1/2} \quad (4)$$

When the bending angle of the piping is 90°, and $p_1=p_2=p$, $u_1=u_2=u$, and $A_1=A_2=A$ assuming that the pressure loss and velocity change near the control sections can be neglected, $$F=\sqrt{2}(\rho Qu+Ap)\ \therefore F=\sqrt{2}(Gu+Ap) \quad (5)$$

where G is a mass flow rate. F is a force constantly acting on the pipe, and acts to distort the piping. Here, vibration of the piping is problematic, in that a change $\Delta F$ is further dominant than the fluid force F because the change acts as an impulse to cause vibration. On the basis of Equation (5), variation $\Delta F$ is expressed as $$\Delta F=\sqrt{2}(G\cdot\Delta u+A\cdot\Delta p) \quad (6)$$

The variation $\Delta F$ of the fluid force discussed here indicates a change in a short period of time, which is caused by the switching of the four-way valves. Therefore, $\Delta u$ and $\Delta p$ in Equation (6) are velocity change and pressure change in the gas piping, respectively, caused when the four-way valves are switched.

In a refrigerating cycle with one four-way valve, the pressure and velocity of the refrigerant change suddenly only when the valve body is switched. In a refrigerating cycle with two four-way valves, however, the pressure changes two times in a stepwise manner as shown in FIGS. 1, 3 and 4. In the refrigerating cycle with two four-way valves, the four-way valves, respectively, suffice to have a half of a capacity of the four-way valve in the refrigerating cycle with one four-way valve, so that the refrigerant having a half of flow rate in the latter causes pressure change whereby weak vibrations occur two times along with the switching of the four-way valves. For users, vibrations of the piping themselves are not a problem, but a secondary shock and impulsive sound generated when the piping strikes a ceiling is rather problematic. This is because the user will not perceive vibration of the piping unless the vibration sound is not heard.

Therefore, since weak vibration of the piping is small in amplitude, the piping is less possible to strike the ceiling, so that the occurrence of small vibration of the piping at two times is less harmful than the occurrence of intense vibration of the piping at one time.

Figure 6A:
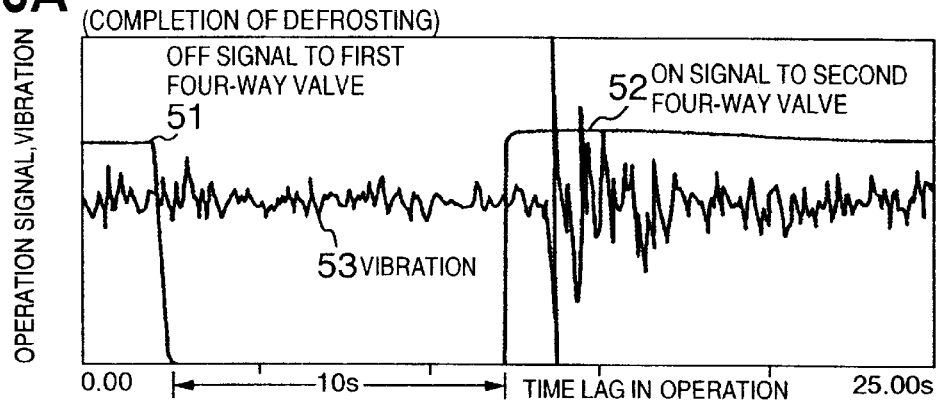
FIGS. 6*a* and 6B are diagrams showing vibrations of piping on the air conditioner and changes in compressor refrigerant suction pressure and gas-side piping pressure when an operation time lag between first and second four-way valves is 10 seconds at the completion of defrosting.
Figure 6B:
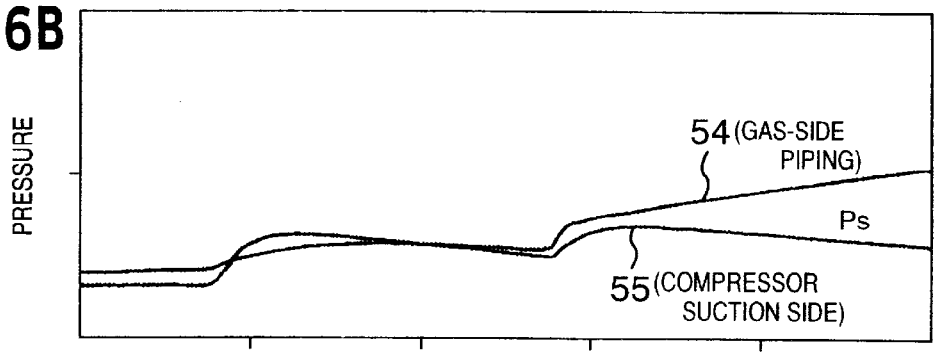
Figure 7A:
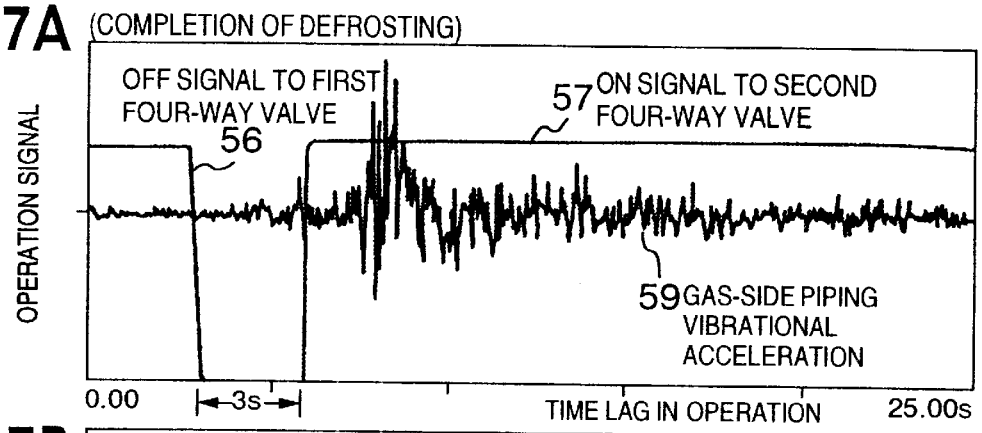
FIGS. 7*a* and 7B are diagrams showing vibrations of piping on the air conditioner and changes in compressor refrigerant suction pressure and gas-side piping pressure when a time lag between first and second four-way valves is 3 seconds at the completion of defrosting.
Figure 7B:
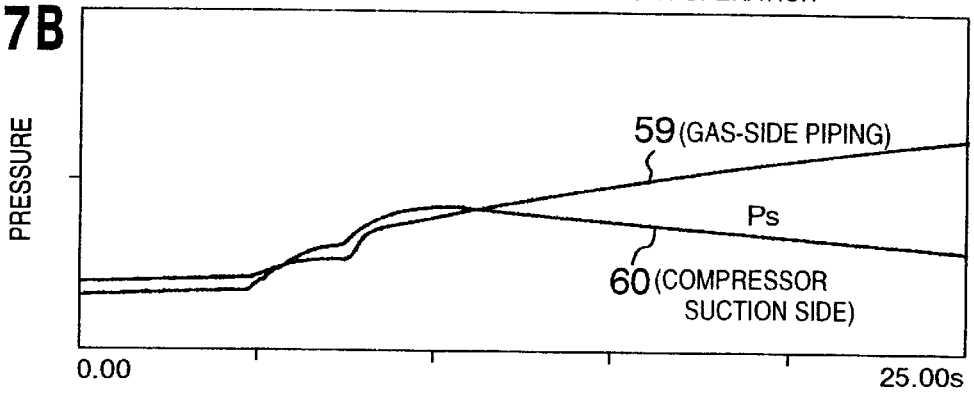

The vibration of the piping varies depending on a time lag in the operation of the four-way valves. FIGS. 6 and 7 show vibration acceleration of the piping in the case where the four-way valves operate at a fixed time lag of 10 seconds and 3 seconds in the same operating condition. In the case where the time lag is 10 seconds as shown in FIG. 6, after the valve body of the first four-way valve 10-1 is turned OFF, the gas-side pressure of the first outdoor heat exchanger 7-1 connected to the first fourway valve 10-1 becomes low to rapidly decrease. However, the second four-way valve 10-2 has not yet been switched, and so the discharged refrigerant cannot flow through the first four-way valve 10-1 due to the check valve 70, and flows toward the second four-way valve 10-2 at once. Although not shown in the drawings, the gas-side pressure of the second outdoor heat exchanger 7-2 connected to the second four-way valve 10-2 and the compressor refrigerant discharge pressure Pd rise, and the pressure in the gas-side pipe line 17 (54 in the drawing) and the compressor refrigerant suction pressure Ps (55 in the drawing) continue to decrease to reach the original values. Thus, the pressure difference between the rising Pd and the decreasing Ps increases. Subsequently, when the second four-way valve 10-2 is switched (52 in the drawing), the pressure change $\Delta p$ with time in the gas piping, included in Equation (6) increases, so that a large vibration occurs.

In contrast, with the time lag of 3 seconds as shown in FIG. 7, the second four-way valve 10-2 is switched before the gas-side pressure of the second outdoor heat exchanger 7-2 connected to the second four-way valve 10-2 and the compressor refrigerant discharge pressure Pd rise and the pressure in the gas-side pipe line 17 (59 in the drawing) and the compressor refrigerant suction pressure Ps (60 in the drawing) decrease, so that a large vibration does not occur.

Thus, since the vibration of the piping changes, all the matter cannot be accommodated by a fixed time lag. While it is described above that a small time lag suffices to achieve the intended effect, an excessively short time lag may cause a danger of resulting in inoperative mode in the case where the four-way valve does not operate at once as shown in the FIG. 3 and as described above. Therefore, the inoperative mode is prevented from resulting and vibration of the piping after defrosting can be suppressed to the minimum by detecting the pressure difference, and sending an operation signal to the subsequent four-way valve at once immediately after the operation of the valve body of the four-way valve operated first is confirmed.

Figure 9A:
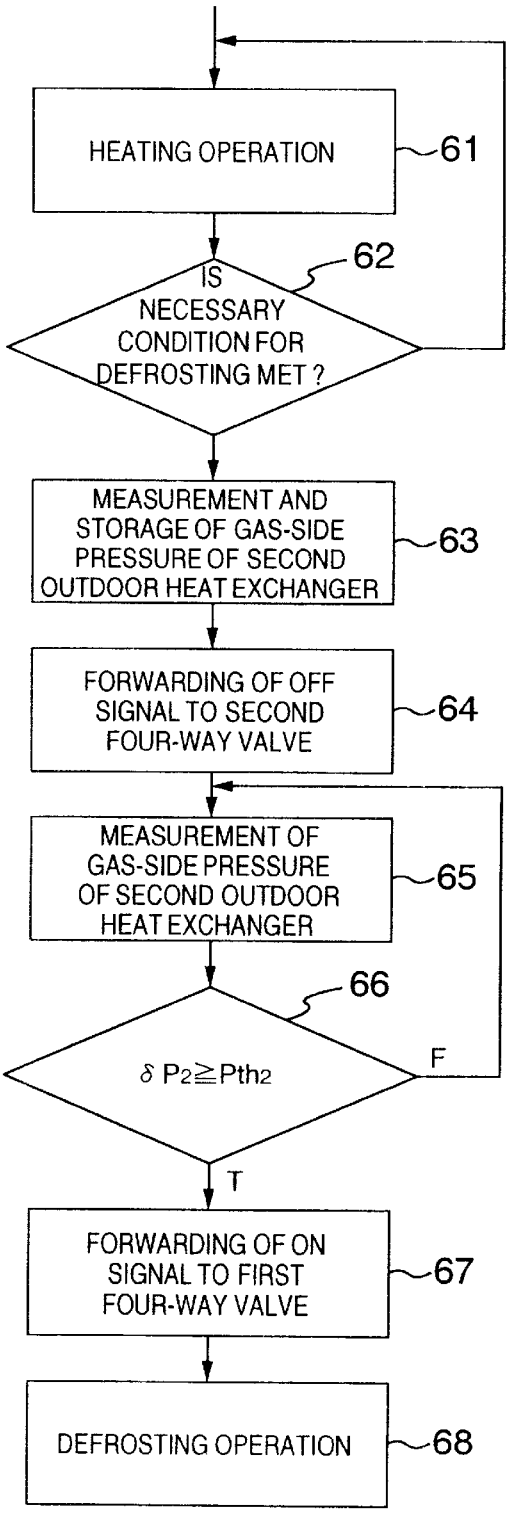
FIGS. 9A and 9B are flowcharts for the operation of four-way valves using the automatic operation device at the start of defrosting and at the completion of defrosting.
Figure 9B:
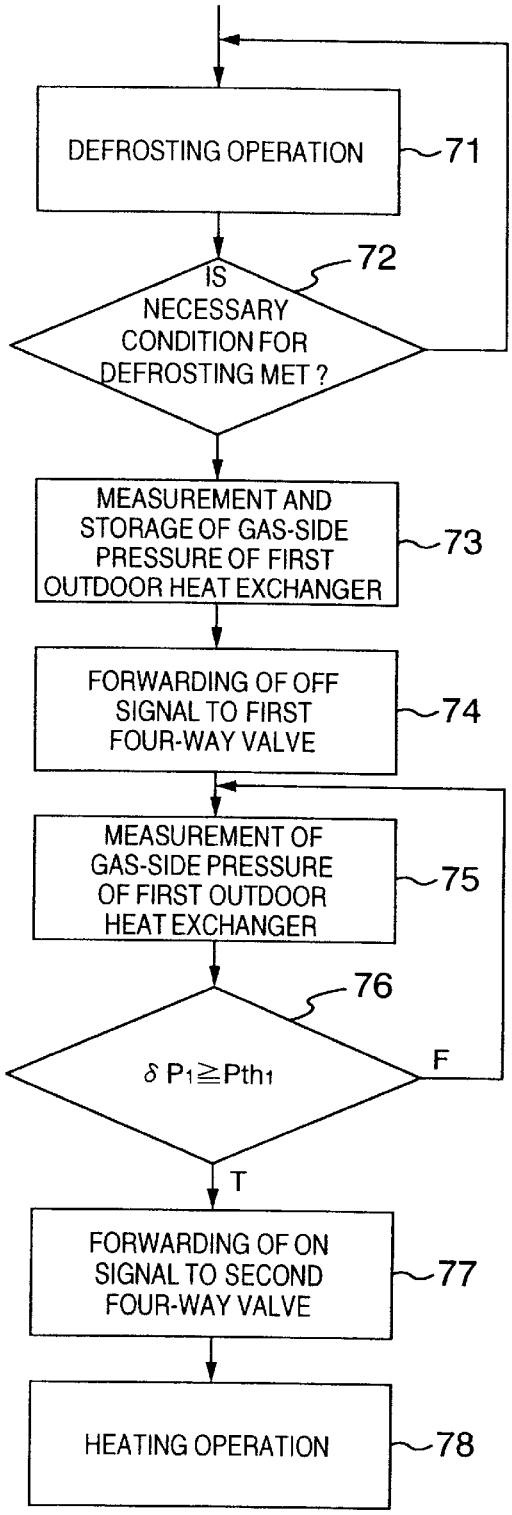

Finally, FIGS. 9A and 9B show an operation flowchart for the four-way valve automatic operation device. First, at the start of defrosting, the heating operation is performed (Step 61) as shown in FIG. 9A. While being influenced by the algorithm for judging the defrosting, for example, when the outdoor heat exchanger evaporation temperature becomes at most a certain value, it is judged that defrosting is necessary (Step 62). Hereupon, the second four-way valve 10-2 is made to operate after the value of the gas-side pressure of the second outdoor heat exchanger 7-2 is measured and stored (Step 63). An OFF signal is forwarded to the second four-way valve 10-2 (Step 64). Subsequently, a value of the gas-side pressure of the second outdoor heat exchanger 7-2 is measured (Step 65) in order to confirm that the valve body of the second four-way valve 10-2 has been operated actually. When the pressure difference $\delta P_2$ between the pressure after the switching signal and the pressure before the switching signal reaches a predetermined value $Pth_2$ (Step 66), an ON signal is forwarded to the first four-way valve 10-1 (Step 67). Then, the heating operation is switched over to the defrosting operation, and defrosting is carried out until the defrosting terminating condition is satisfied (Step 68).

The same is the case at the completion of defrosting. As shown in FIG. 9B, when the defrosting operation is performed (Step 71), it is judged whether or not the defrosting completion condition is satisfied (Step 72). If defrosting is deemed to be completed, the value of the gas-side pressure of the first outdoor heat exchanger 7-1 is measured and stored (Step 73) before the first four-way valve 10-1 is switched. Then, an OFF signal is sent to the first four-way valve 10-1 (Step 74). Further, the value of the gas-side pressure of the first outdoor heat exchanger 7-1 is measured (Step 75). When the pressure difference $\delta P_1$ between pressures before and after the switching signal is sent reaches a threshold value $Pth_1$ (Step 76), the valve body of the first four-way valve 10-1 is deemed to have been operated, and an ON signal is transmitted to the second four-way valve 10-2 (Step 77). Here, the defrosting operation is completed, and the heating operation is restarted (Step 78).

According to the present invention, an air conditioner having an outdoor unit provided with two four-way valves is provided with a control device, as a four-way valve control device, the control device serving, when the mode is switched from the heating operation to the defrosting operation or inversely from the defrosting operation to the heating operation, to switch one of the two four-way valves in accordance with the sequence, in which the high and low pressure sides side of the outdoor unit are not short-circuited, and switching the other of the four-way valves after detecting, on the basis of a change in the gas-side pressure of the outdoor heat exchanger, that the one of the four-way valves has been switched surely. Therefore, non-operation of the four-way valves is prevented, and reliable mode switching can be performed. Also, stepwise switching of the two four-way valves reduces vibration of the piping in the air conditioner, so that more comfortable and stable operation can be performed.

What is claimed is:

1. An air conditioner provided with an indoor unit or units having an indoor expansion valve and an indoor heat exchanger and an outdoor unit having a compressor, a first outdoor heat exchanger, a second outdoor heat exchanger, a first four-way valve and a second four-way valve, the air conditioner comprising:

a discharge pressure sensor for sensing discharge pressure of said compressor, and an suction pressure sensor for sensing suction pressure of said compressor; and a four-way valve control device for switching said second four-way valve if a pressure difference between said discharge pressure and said suction pressure reaches or exceeds a predetermined value when said air conditioner is to be switched from heating operation to defrosting operation, and for switching said first four-way valve subsequently.

2. An air conditioner provided with an indoor unit or units having an indoor expansion valve and an indoor heat exchanger and an outdoor unit having a compressor, a first outdoor heat exchanger and a second outdoor heat exchanger, the air conditioner comprising:

a first four-way valve connected to said first outdoor heat exchanger, and a second four-way valve connected to said second outdoor heat exchanger; and a four-way valve control device for controlling switching of said first four-way valve by confirming that an increased value of the gas-side pressure of said second outdoor heat exchanger after switching reaches or exceeds a predetermined threshold value after said second four-way valve has been switched.

3. An air conditioner provided with an indoor unit or units having an indoor expansion valve and an indoor heat exchanger and an outdoor unit having a compressor, a first outdoor heat exchanger and a second outdoor heat exchanger, the air conditioner comprising:

a first four-way valve connected to said first outdoor heat exchanger, and a second four-way valve connected to said second outdoor heat exchanger; and a four-way valve control device for, in returning said air conditioner from defrosting operation to heating operation, switching said first four-way valve after a pressure difference between said discharge pressure and said suction pressure reaches or exceeds a predetermined value and switching said second four-way valve after the gas-side pressure of said first outdoor heat exchanger has decreased below a predetermined threshold value.

4. The air conditioner according to one of claims 2 to 3, wherein said compressor is made variable in capacity by changing a drive frequency thereof.

5. In an air conditioner comprising an outdoor unit, an indoor unit or units connected to said outdoor unit by a liquid-side piping and a gas-side piping, and a forward circulating path for a refrigerant, said outdoor unit being constructed such that one of pipes branching on the discharge side of a drive frequency variable type compressor is connected to a first four-way valve, a first outdoor heat exchanger and a first outdoor expansion valve in this order, the other of the pipes is connected to a second four-way valve, a second outdoor heat exchanger and a second outdoor expansion valve in this order, and outflowing sides of the said respective outdoor expansion valves join together to be connected to said liquid-side piping, and said indoor unit or units being constructed such that an indoor expansion valve and an indoor heat exchanger are connected in this order from said liquid piping side, and that one of pipes, which return to said outdoor unit from said gas-side piping connected to said indoor heat exchanger and branches, is connected to said first four-way valve via a check valve in communication in a forward direction, and the other of the pipes is connected to said second four-way valve, the refrigerant flowing along the forward circulating path at the time of cooling and defrosting operations and flowing in a direction reverse to the forward circulating path at the time of heating operation, the improvement comprising means for sensing discharge pressure of said compressor, means for sensing suction pressure of said compressor, means for sensing gas-side pressures of said respective outdoor heat exchangers, and a four-way valve control device for operating said first and second four-way valves on the basis of detected values of said respective pressures, and wherein said four-way valve control device controls, when heating operation is switched over to defrosting operation, to first switch said second four-way valve if a pressure difference between said compressor discharge pressure and said compressor suction pressure is equal to or above a predetermined value, and to switch said first four-way valve after the gas-side pressure of said second outdoor heat exchanger has risen.

6. The air conditioner according to claim 5, wherein said four-way valve control device controls, when defrosting operation is switched over to heating operation, to first switch said first four-way valve if a pressure difference between said compressor discharge pressure and said compressor suction pressure is equal to or above a predetermined value, and to switch said second four-way valve after the gas-side pressure of said first outdoor heat exchanger has decreased.

* * * * *